US005936182A

United States Patent [19]

Izumisawa

[11] Patent Number: 5,936,182

[45] Date of Patent: Aug. 10, 1999

[54] MUSICAL TONE SYNTHESIZER FOR REPRODUCING A PLURAL SERIES OF OVERTONES HAVING DIFFERENT INHARMONICITIES

[75] Inventor: Gen Izumisawa, Hamamatsu, Japan

[73] Assignee: Kabushiki Kaisha Kawai Gakki Seisakusho, Japan

[21] Appl. No.: 09/102,996

[22] Filed: Jun. 22, 1998

[30] Foreign Application Priority Data

Jun. 25, 1997 [JP] Japan ..... 9-184377

[51] Int. Cl.[6] ..... G10H 11/04; G10H 1/08

[52] U.S. Cl. ..... 84/623; 84/625; 84/626; 84/658; 84/660

[58] Field of Search ..... 84/622–626, 631, 84/632, 658–661, 664, 692–700, 708, 710, DIG. 4

[56] References Cited

U.S. PATENT DOCUMENTS

| | | | |
|---|---|---|---|
| 3,809,792 | 5/1974 | Deutsch | 84/DIG. 4 |
| 3,884,108 | 5/1975 | Deutsch | 84/DIG. 4 |
| 3,888,153 | 6/1975 | Deutsch | 84/625 |
| 3,978,755 | 9/1976 | Woron | 84/DIG. 4 |
| 4,082,028 | 4/1978 | Deutsch | 84/623 |
| 4,112,803 | 9/1978 | Deutsch | 84/DIG. 4 |
| 4,273,018 | 6/1981 | Deutsch | 84/625 |
| 4,905,562 | 3/1990 | Beacham et al. | 84/623 X |
| 5,357,575 | 10/1994 | Kitamura | 84/622 X |

FOREIGN PATENT DOCUMENTS 9-70908 7/1993 Japan .

OTHER PUBLICATIONS

*Technical Report of IEICE* EA93–28 (Jul. 1993), pp. 9–15, published by The Institute of Electronics, Information and Communication Engineers.

*Primary Examiner*—Stanley J. Witkowski
*Attorney, Agent, or Firm*—Christie, Parker & Hale, LLP

[57] ABSTRACT

A musical sound synthesizing apparatus synthesizes plural-series overtones having different inharmonicity and amplitude level so as to generate a musical sound close to a natural sound. Inharmonicity coefficients K1 and K2 are read out for each overtone of different series in accordance with a timbre and a pitch, preferably modified according to a touch velocity, and then inputted to the first and second overtone frequency generators 19 and 20. Two series of overtones respectively computed in first and second overtone generators 21 and 22 on the basis of fundamental and overtone frequencies computed using of the coefficients K1 and K2, are controlled in its amplitude by the multipliers 25 and 26, and then synthesized so as to be outputted as a musical sound signal. In the multipliers 25 and 26, respective overtones are multiplied by amplitude coefficients Lk1 and Lk2 determined for each series in accordance with the touch velocity so that their amplitude levels are modified.

11 Claims, 9 Drawing Sheets

MUSICAL TONE SYNTHESIZER FOR REPRODUCING A PLURAL SERIES OF OVERTONES HAVING DIFFERENT INHARMONICITIES

BACKGROUND OF THE INVENTION

1. Field of the Invention

The present invention relates to a musical sound synthesizing apparatus, and in particular, to a musical sound synthesizing apparatus which preferably generates a musical sound having inharmonicity, such as a piano sound, a guitar sound or the like.

2. Description of the Related Art

In general, a wave form of musical sound is composed by synthesizing a plurality of types of sine waves. These sine waves are called overtones (harmonic tones) because their frequency has an integer times relation with a single frequency. In particular, an overtone of the lowest frequency is called a fundamental wave, and the frequency of the fundamental wave is called a fundamental frequency. The frequency of each of the other overtones is an integer times as much as the fundamental frequency. A relative level relation between the overtones is called an overtone structure, and a timbre of musical sound determination depends upon a difference in the overtone structure.

In electronic musical instruments, there is a known overtone synthesis method which is called a sine wave harmonics synthesis method of generating a plurality of sine waves at overtone frequencies, and accumulating these sine waves so as to synthesize a musical sound. According to that method, a fundamental frequency corresponding to a pitch is stored in a memory as a frequency table, and the fundamental frequency is read from the frequency table using the pitch as a key. And then, by multiplying the fundamental frequency by an integer, a frequency of each overtone other than the fundamental frequency is computed (calculated), and these frequencies are synthesized so that a desired musical sound is obtained. Since the fundamental frequency corresponding to a pitch is common in many musical sounds, a memory capacity for storing the aforesaid frequency table can be small. According to the sine wave harmonics synthesis method, a sound having the same overtone structure as a natural musical sound is generated, and thereby, it is possible to reproduce a musical sound close to that of a natural musical instrument.

For example, in musical sounds of natural musical instruments such as a piano, a guitar or the like, a frequency of each overtone is not an exact integer times as much as the fundamental frequency, but is slightly shifted from the integer times. More specifically, in these musical sounds, the frequency of an overtone is slightly higher than the integer times of the fundamental frequency. The higher the degree of overtone is, the larger the shift is. The quality of musical sound as described above is called inharmonicity. The degree of inharmonicity differs depending upon the type of musical instrument, and also, even in the same type of musical instrument, a difference occurs in between lower and higher tones. The inventor of the present invention has already invented a musical sound synthesizing apparatus which can vary an inharmonicity of musical sound according to a pitch of the musical sound, a timbre and touch strength (see Japanese Patent Application No. Hei 9-70908).

Even in the sine wave harmonics synthesis method, the aforesaid musical sound synthesizing apparatus can generate a wave form of an overtone structure closer to the sound of natural instruments having an inharmonicity using a memory with a small capacity for the frequency table. However, the overtone structure of natural instruments is further complicated. FIG. 11 shows a spectrum distribution of a piano sound, and in the figure, the ordinate takes an amplitude (dB) and the abscissa takes a frequency (kHz). In FIG. 11, it is found that in addition to each overtone A having inharmonicity, there exists a frequency component "a" of a relatively high amplitude level different from a noise, adjacent to the overtone A (see a partially enlarged view of FIG. 11). This is called a "spectral split", and a series of split components "a" shows an inharmonicity and an amplitude level which are different from the essential series of overtones A. The essential series of overtones A is called an "upper series"; on the other hand, the series of split components "a" is called a "lower series".

To give an example, the following is an explanation about inharmonicity of a musical sound of a piano. The inharmonicity is expressed by shift δn (cent value) of an n-th overtone frequency fn from an integer times n.f0 of a fundamental frequency f0 (fundamental frequency of an ideal string without elasticity), and is obtained from the following equation (1).

$$\delta n = 1200 \log 2 \, (fn/n.f0) \tag{1}$$

FIG. 12 shows inharmonicity of a piano sound obtained from the above equation (1). In FIG. 12, the inharmonicity is expressed by a cent value (ordinate). As seen from FIG. 12, the upper series and the lower series are different in inharmonicity, and therefore, it is found that the piano sound comprises the two series of inharmonious overtones which are overlapped and different from each other. Also, a mixture ratio of the upper and the lower series is variable depending upon touch, that is, a note on (key on) strength of a keyboard. In most musical instruments having inharmonicity, the spectral split as described above appears therein. The aforesaid inharmonicity of piano sound and spectral split have been disclosed and discussed in pages 9 to 15 of "TECHNICAL REPORT OF IEICE EA93-28 (1993-07)" published by THE INSTITUTE OF ELECTRONICS, INFORMATION AND COMMUNICATION ENGINEERS.

SUMMARY OF THE INVENTION

In the musical sound synthesizing apparatus previously proposed by the inventor of the present invention, the inventor was not interested in the aforesaid two kinds of inharmonicity. For this reason, there has arisen a problem such that the musical sound synthesizing apparatus is insufficient to generate a wave form having a further complicated overtone structure, and therefore, a further improvement is required.

An object of the present invention is to provide a musical sound synthesizing apparatus which can vary an inharmonicity in accordance with a pitch, a timbre, touch or the like.

According to a first feature, the present invention provides a musical sound synthesizing apparatus comprising a plurality of inharmonicity coefficient generator means supplied with a pitch information of a musical sound, for outputting inharmonicity coefficients previously set in accordance with the pitch information, a plurality of overtone frequency generator means for computing overtone frequencies using the inharmonicity coefficient outputted from the inharmonicity coefficient generator means and a fundamental frequency corresponding to the pitch information, a plurality of overtone generator means for generating a musical sound signal corresponding to the overtone frequencies, where in the plurality of inharmonicity coefficients corresponding respectively to a plural-series overtones having amplitude levels and inharmonicity which are different from each other.

According to a second feature, in addition to the first feature, the present invention provides a musical sound synthesizing apparatus wherein the musical sound synthesizing apparatus further includes inharmonicity touch coefficient generator means being supplied with touch information, for outputting inharmonicity touch coefficients previously set in accordance with the touch information, and a plurality of first multiplier means for multiplying each of the plurality of inharmonicity coefficients outputted from the inharmonicity coefficient generator means by the inharmonicity touch coefficients, and wherein the overtone frequency generator means computes the overtone frequencies using the plurality of inharmonicity coefficients multiplied by the inharmonicity touch coefficients.

According to a third feature, the present invention provides a musical sound synthesizing apparatus wherein the musical sound synthesizing apparatus further includes amplitude coefficient generator means being supplied with touch information, for outputting a plurality of amplitude coefficients for the plural series in accordance with the touch information, a plurality of second multiplier means for individually multiplying plural series overtones outputted from the overtone generator means by a corresponding one of the plural amplitude coefficients, and adder means for adding plurality outputs of the multiplier means with each other to generate a musical sound.

According to the first to third features, it is possible to have a musical sound of a plural series having a different amplitude level and inharmonicity based on overtone frequencies computed with the use of inharmonicity coefficients previously set corresponding to a pitch of musical sound. In particular, according to the second feature, the inharmonicity coefficient is modified by means of inharmonicity touch coefficient selected based on touch information. Further, according to the third feature, the amplitude level is adjusted (controlled) for each plural-series overtone, and then, the adjusted overtone is mixed by means of the adder means, so that the mixture ratio of overtone for each series can be changed.

DETAILED DESCRIPTION OF THE PREFERRED EMBODIMENTS

Figure 2:
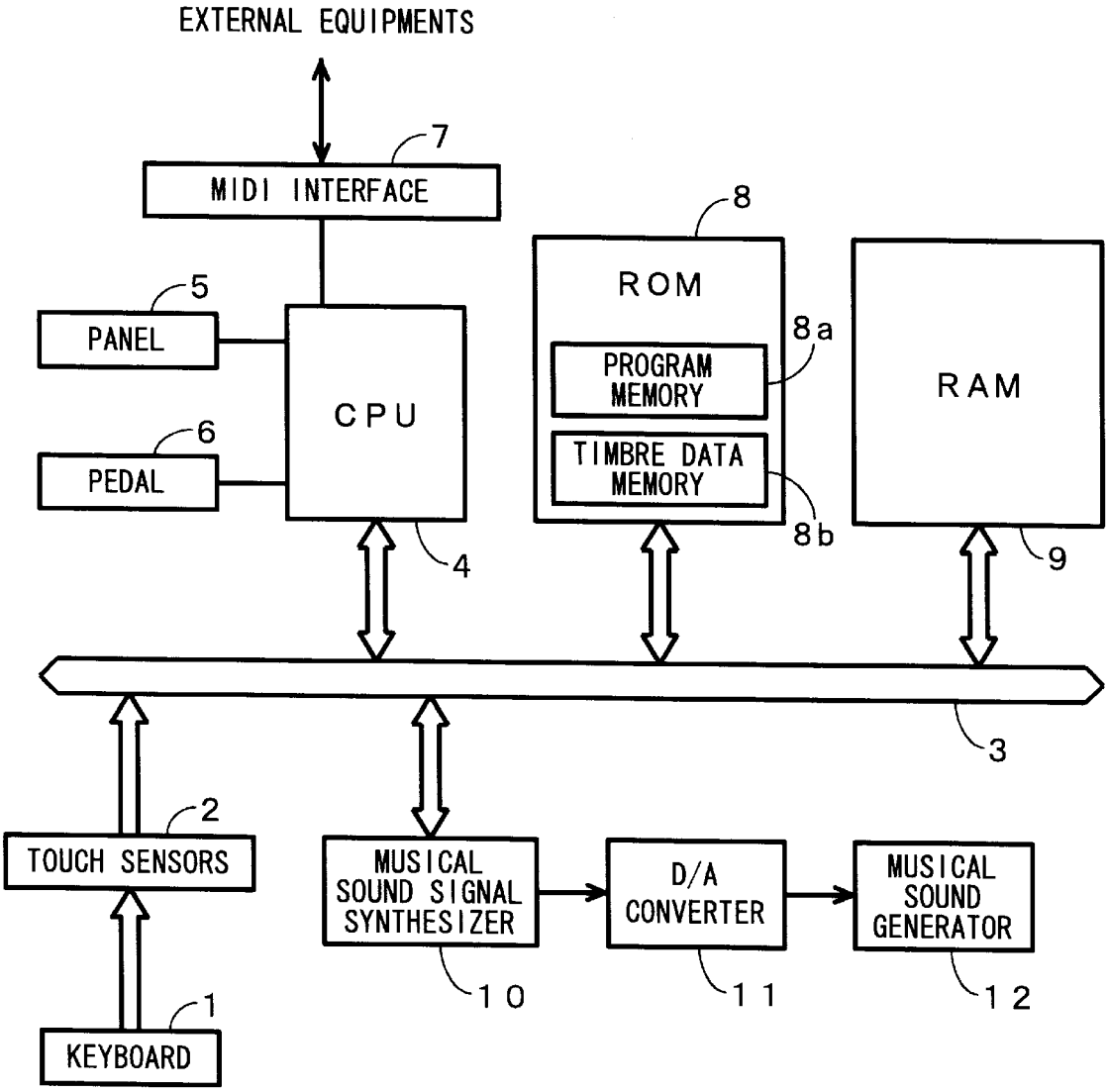
FIG. 2 is a block diagram showing a hardware configuration of the musical sound synthesizing apparatus according to the first embodiment of the present invention.

The present invention will be described with reference to the accompanying drawings. FIG. 2 is a block diagram showing a hardware configuration of an electronic musical instrument including a musical sound synthesizing apparatus according to the first embodiment of the present invention. In FIG. 2, a keyboard 1 has a plurality of keys, and note on/off states of the plural keys are detected by means of a plurality of touch sensors 2 provided correspondingly to these keys. The touch sensor 2 is connected to a bus 3, and a key code and touch information detected by the touch sensor 2 are inputted to a CPU 4 via the bus 3. The CPU 4 is connected with a panel 5 having various switches such as a power switch, a timbre selection switch, a volume (loudness) switch or the like, and a pedal 6 for producing damper effect and soft effect. Also, it is possible to connect external equipments to the CPU 4 via a MIDI interface 7. A ROM 8 is used as a program memory 8*a* for storing programs executed by the CPU 4 and as a timbre data memory 8*b* for storing a timbre data. A RAM 9 is provided for storing variable data such as a register, a flag or the like.

The CPU 4 executes various routine processes using programs and data stored in the ROM 8 and the RAM 9 according to a signal inputted from the panel 5 and the pedal 6, and then, outputs an instruction based on the processing result to a musical sound signal synthesizing section 10. The musical sound signal synthesizing section 10 synthesizes a musical sound signal based on the instruction from the CPU 4. Then, the musical sound signal synthesized is converted into an analog data by means of a D/A converter 11, and thereafter, is supplied to a musical sound generator system 12 comprising an amplifier and a speaker, and thus, a musical sound is emitted from the musical sound generator system 12.

Figure 1:
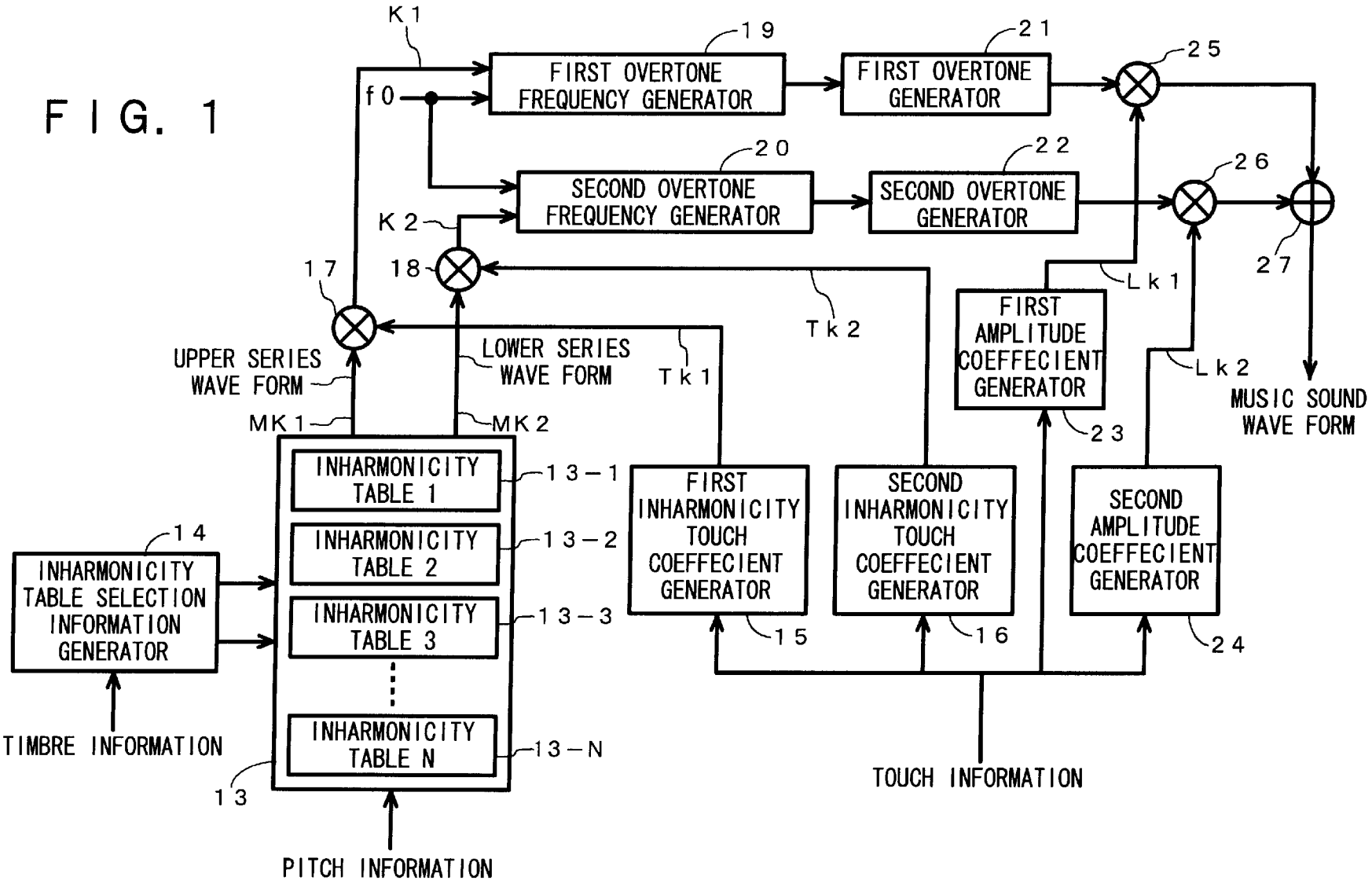
FIG. 1 is a block diagram showing principal parts and functions of a musical sound synthesizing apparatus according to a first embodiment of the present invention.
Figure 8:
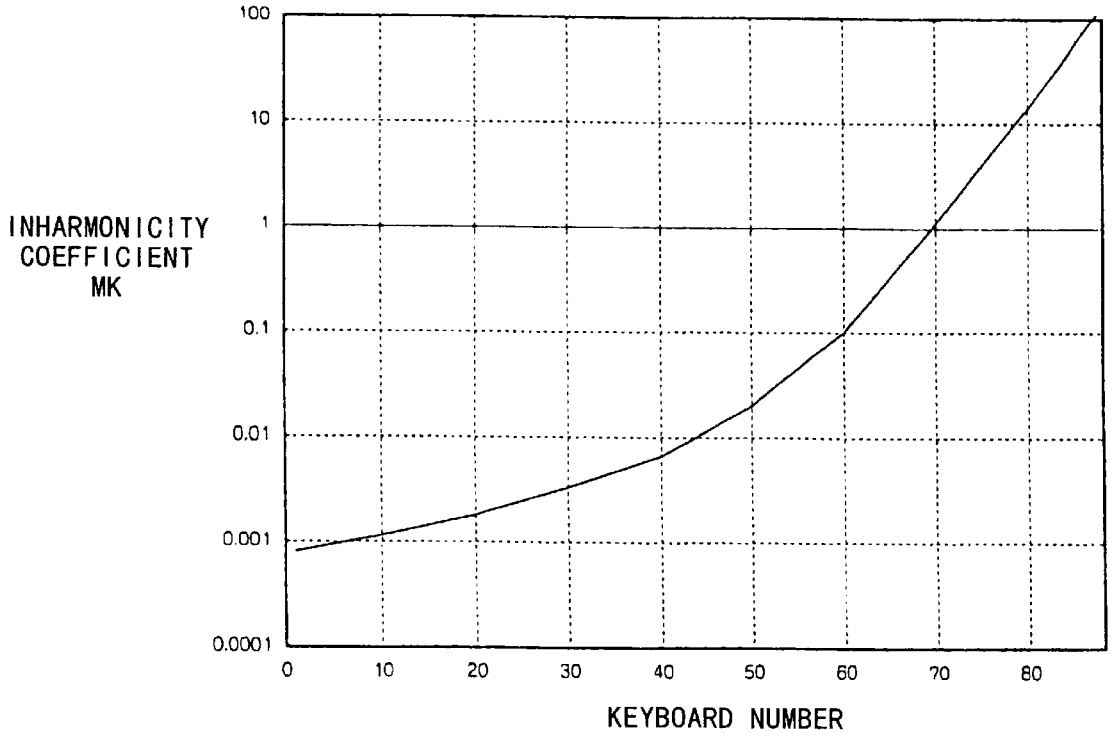
FIG. 8 is a diagram showing an example of an inharmonicity coefficient table.

Functions of principle parts of the musical sound synthesizing apparatus according to the present embodiment will be described with reference to a block diagram of FIG. 1. In FIG. 1, a plurality of inharmonicity tables 13-1, 13-2, . . . 13-N for different timbres are stored in an inharmonicity table group 13 which functions as inharmonicity coefficient generator means present in the ROM 8. In each of inharmonicity tables 13-1 to 13-N, there is a preset correspondent relationship between an inharmonicity coefficient MK and a keyboard number, that is, a pitch information. An example is shown in FIG. 8. The inharmonicity coefficient MK is modified by an inharmonicity touch coefficient Tk which will be described later, and is used in an overtone frequency operation.

An inharmonicity table selection information generator section 14 generates selection information, that is, two addresses for selecting two inharmonicity tables, out of the plurality of inharmonicity tables based on timbre information inputted from the panel 5. The two inharmonicity tables selected by said two addresses correspond to an upper series and a lower series, respectively. Which of the inharmonicity tables should be selected, is previously set for each timbre. The relationship between the upper and the lower series inharmonicity tables to be selected is determined as follows. For example, the table shown in FIG. 8 is selected as an upper series. Another table having a degree of inharmonicity less than the upper series, that is, a table having a less inclination of a inharmonicity coefficient MK curve, is selected as a lower series.

The inharmonicity table group 13 does not always have an independent table for each of the upper series and the lower series. For example, the inharmonicity table group can consist of a one-series inharmonicity table for each timbre. In that case, predetermined inharmonicity tables corresponding to two timbres, which are different from each other, are selected from the one-series inharmonicity table as the upper series and the lower series inharmonicity tables, when the timbre information provides. In other words, when multiple inharmonicity tables which are different from each other are provided, then it is necessary to select two tables out of the multiple tables. Further, pitch information detected by the touch sensor 2 is inputted as an address to the inharmonicity table selected by the inharmonicity table selection information generator section 14, and then, a fundamental inharmonicity coefficient MK1 for the upper series and a fundamental inharmonicity coefficient MK2 for the lower series corresponding to the address are read out.

Figure 9:
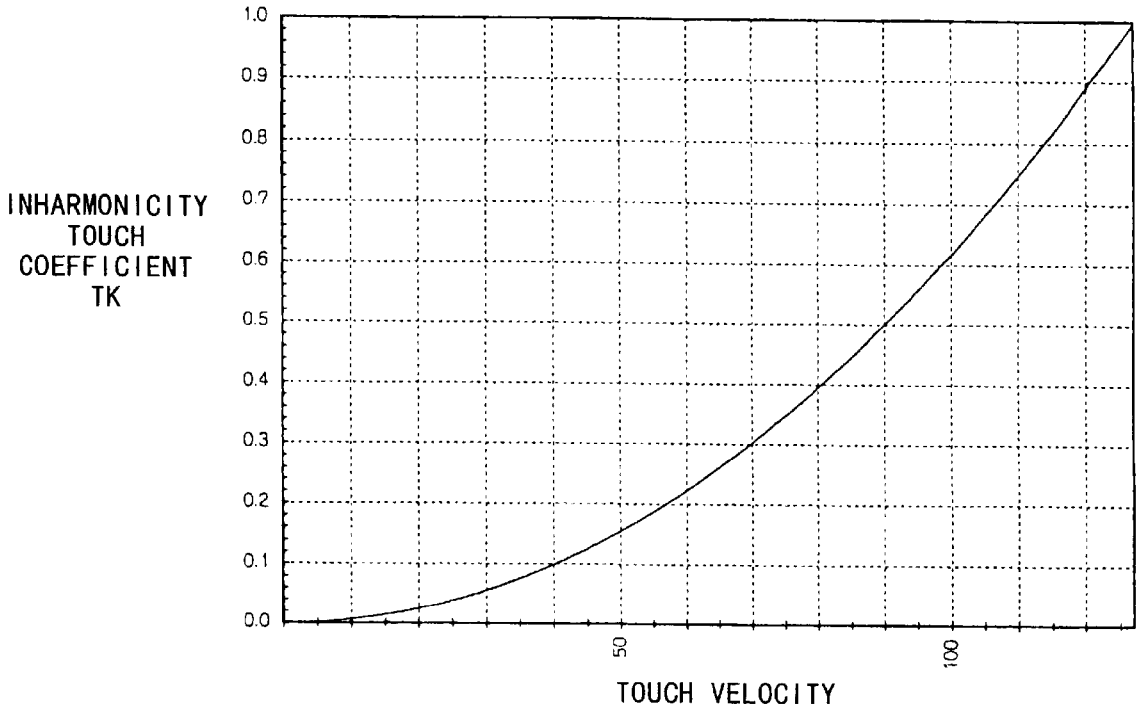
FIG. 9 is a diagram showing an example of an inharmonicity touch coefficient table.

In a first inharmonicity touch coefficient generator section 15 and a second inharmonicity touch coefficient generator section 16, there is a preset table (touch curve table) showing a correspondent relationship between the inharmonicity touch coefficient Tk and touch information which is touch velocity or touch strength, as shown by example in FIG. 9. The touch velocity is computed by the CPU 4 based on a detection signal of the touch sensor 2. As the touch sensor 2 for detecting the touch velocity and the touch velocity computing method are well-known, their details are omitted here. The first and second inharmonicity touch coefficient generator sections 15 and 16 are tables pre-stored in the ROM 8, and individually output an upper series inharmonicity touch coefficient Tk1 and a lower series inharmonicity touch coefficient Tk2 according to the touch velocity.

In multiplier sections 17 and 18, the fundamental inharmonicity coefficients MK1 and MK2 are respectively multiplied by the inharmonicity touch coefficients Tk1 and Tk2 and then, an upper series inharmonicity coefficient K1 and a lower series inharmonicity coefficient K2 modified in accordance with the touch velocity, are obtained. The inharmonicity coefficients K1 and K2 are inputted into a first overtone frequency generator section 19 and a second overtone frequency generator section 20, respectively. The first and second overtone frequency generator sections 19 and 20 compute overtone frequencies in sequence based on the fundamental frequency f0 corresponding to the pitch information and inharmonicity coefficients K1 and K2, and then, transmit these frequencies to a first overtone generator section 21 and a second overtone generator section 22, respectively. The fundamental frequency f0 may be generated corresponding to the pitch information by looking up a known frequency table (not shown) or may be calculated using predetermined known formula. The first and second overtone generator sections 21 and 22 may be digital controlled oscillators (DCO), and generate in sequence overtone wave forms with adequate amplitudes and the inputted frequencies. An amplitude of each overtone may be read out from overtone wave amplitude table (not shown) in which the amplitude for each overtone corresponding to the pitch information is stored. The generated overtone waves are synthesized by synthesize means in the first and second overtone generator section 21, 22, respectively.

A frequency of each overtone fn is computed from the following equation (2) in which the inharmonicity coefficients K1 and K2 are represented by a common symbol K, and n is a positive integer.

$$fn=n-f0(1+K.n^2)^{1/2} \quad (2)$$

In order to simplify the operation of the equation (2) and to make small a scale of computer circuit, the following approximate equation (3) may be used.

$$fn=n.f0+Ka.n^3 \quad (3)$$

In the above equation (3), the inharmonicity coefficients K1 and K2 are represented by another common symbol Ka. The inharmonicity coefficient Ka is used for the approximate equation (3), and has a value different from the inharmonicity coefficient K in the equation (2).

Also, the aforesaid touch information is inputted to a first amplitude coefficient generator section 23 and a second amplitude coefficient generator section 24. These first and second amplitude coefficient generator section 23 and 24 are tables individually storing a first and second amplitude coefficient LK1 and Lk2 corresponding to the touch information, and then, generate amplitude coefficients LK1 and Lk2 in accordance with the input touch information. Preferably, these amplitude coefficients LK1 and Lk2 are set so that the stronger the touch is, the larger an amplitude of the frequency component of the lower series is, and thus the amplitude approximates to that of the upper series frequency components.

Further, the amplitude coefficients LK1 and Lk2 are supplied to multiplier sections 25 and 26, respectively, and then, the synthesized wave forms of overtones outputted from first and second overtone generator sections 21 and 22 are multiplied by the amplitude coefficients LK1 and Lk2, respectively. And then, two wave forms modified by the amplitude coefficients LK1 and Lk2 are added by an adder 27, respectively. As a result, upper series and lower series wave form components are adjusted by a mixture ratio determined depending upon these amplitude coefficients LK1 and Lk2, and thereafter, are inputted to the musical sound generator system 12 as a musical sound signal.

Figure 3:
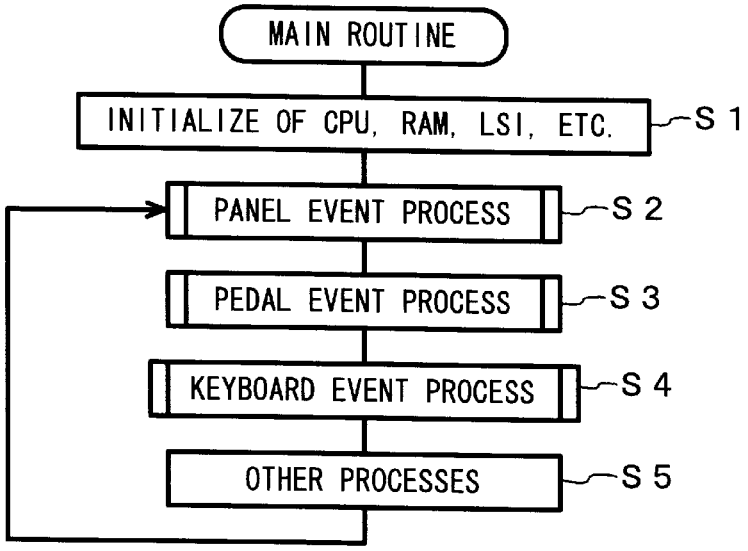
FIG. 3 is a main flowchart showing a main routine of the musical sound synthesizing apparatus.

An operation of the musical sound synthesizing apparatus based on the aforesaid function will be described below with reference to a flowchart of FIG. 3. FIG. 3 is a flowchart of a main routine. When a power source is turned on, in step S1, the CPU 4, the RAM9 and the LSI musical sound generator section 10 is initialized. In step S2, step S3 and step S4, a panel event process, a pedal event process and a keyboard event process are sequentially executed. In step S5, other processes are executed. The panel event process and the keyboard event process will be described later, however, the explanation about the pedal event process and other processes is omitted because they have nothing to do with the present invention.

Figure 4:
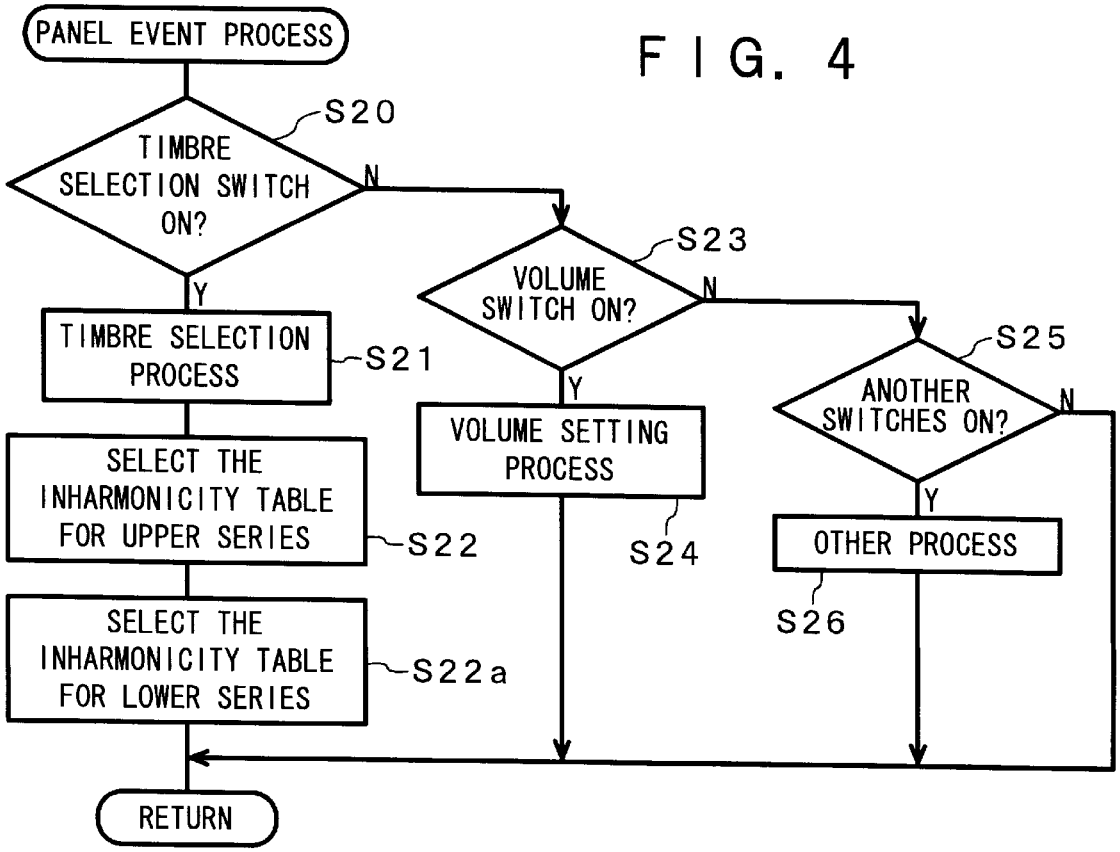
FIG. 4 is a flowchart showing a panel event process.

The panel event process will be described below with reference to the flowchart of FIG. 4. In step S20, a decision is made whether or not the timbre selection switch is turned on. If the timbre selection switch is turned on, the sequence proceeds to step S21 to execute a timbre selection process. In the timbre selection process, a flag showing a selected timbre is set, and a display lamp (LED, etc.) corresponding to the selected timbre is lighted. The display lamp may be provided in the panel 5. In step S22, one of inharmonicity tables 13-1 to 13-N is selected as a table for an upper series on the basis of timbre information inputted from the timbre selection switch. Further, in step S22*a*, another inharmonicity table different from that selected in step S22 is selected out of tables 13-1 to 13-N as a table for a lower series based on the timbre information.

In step S20, in the case where a decision is made that the timbre selection switch is not turned on, the sequence proceeds to step S23, and a decision is made whether or not the volume switch is turned on. If the volume switch is turned on, the sequence proceeds to step S24 to execute a volume setting process. In the volume setting process, volume is set according to the on-operation of the volume switch. For example, a volume control rate for each on-operation of the volume switch is previously set, and a set volume is varied by the volume control rate.

In the case where a decision is made in step S23 that the volume switch is not turned on, the sequence proceeds to step S25, and a decision is made whether or not any other switch is turned on. If the result is Yes, in step S26, a predetermined process corresponding to another switch is executed. Further, if none of switches are turned on, the process of this flowchart ends, and the sequence returns to the main routine.

Figure 5:
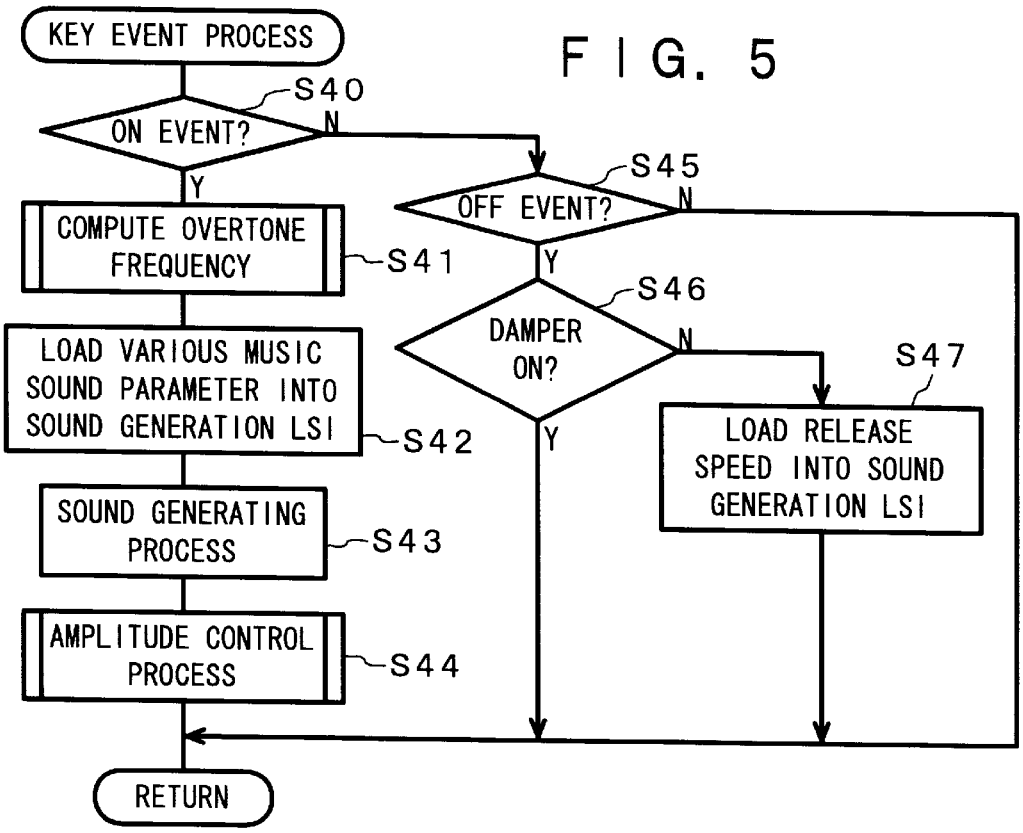
FIG. 5 is a flowchart showing a keyboard event process.

The keyboard event process will be described with reference to the flowchart of FIG. 5. In step S40, a decision is made whether or not the keyboard 1 is on-operated. If the decision is affirmative, the sequence proceeds to step S41 in which the overtone frequency fn is computed according to the equation (2) or equation (3) and the sine wave harmonics synthesis operation is executed. The details of the overtone frequency computing process will be described later with reference to FIG. 6.

In step S42, various parameters of musical sound, such as an envelope, decay time or the like, are computed so as to be loaded into a tone generator LSI of the first and second overtone generator sections 21 and 22. The various parameters of musical sound are computed based on input information such as a key code, touch strength or the like. In step S43, a sound signal generating process is executed by first and second overtone generator sections 21 and 22. In this case, the sound signal is synthesized according to the sine wave harmonics synthesis frequencies, and then, an envelope or the like is added to generate a musical sound. In step S44, an amplitude control process for adjusting (controlling) the mixture ratio of wave form components of upper series and lower series is executed. The details of the amplitude control process will be described later with reference to FIG. 7.

In the case where the event is not an on-event, the sequence proceeds to step S45 from step S40 in which a decision is made whether or not it is a note-off, that is, an off-event. If the decision is affirmative, the sequence proceeds to step S46 where a decision is made whether or not the damper pedal is on. If the damper pedal is on, the sequence returns to the main routine without muffling a sound. In the case where the damper pedal is not on, the sequence proceeds from step S46 to step S47, and in order to attenuate (mute) the sound signal, parameters for determining a predetermined release speed, that is, the time until sound is muffled after note-off, are loaded into the tone generator LSI of the first and second overtone generator sections 21 and 22. Further, if it is not an off-event, step S46 and step S47 are skipped over, and the sequence returns to the main routine.

Figure 6:
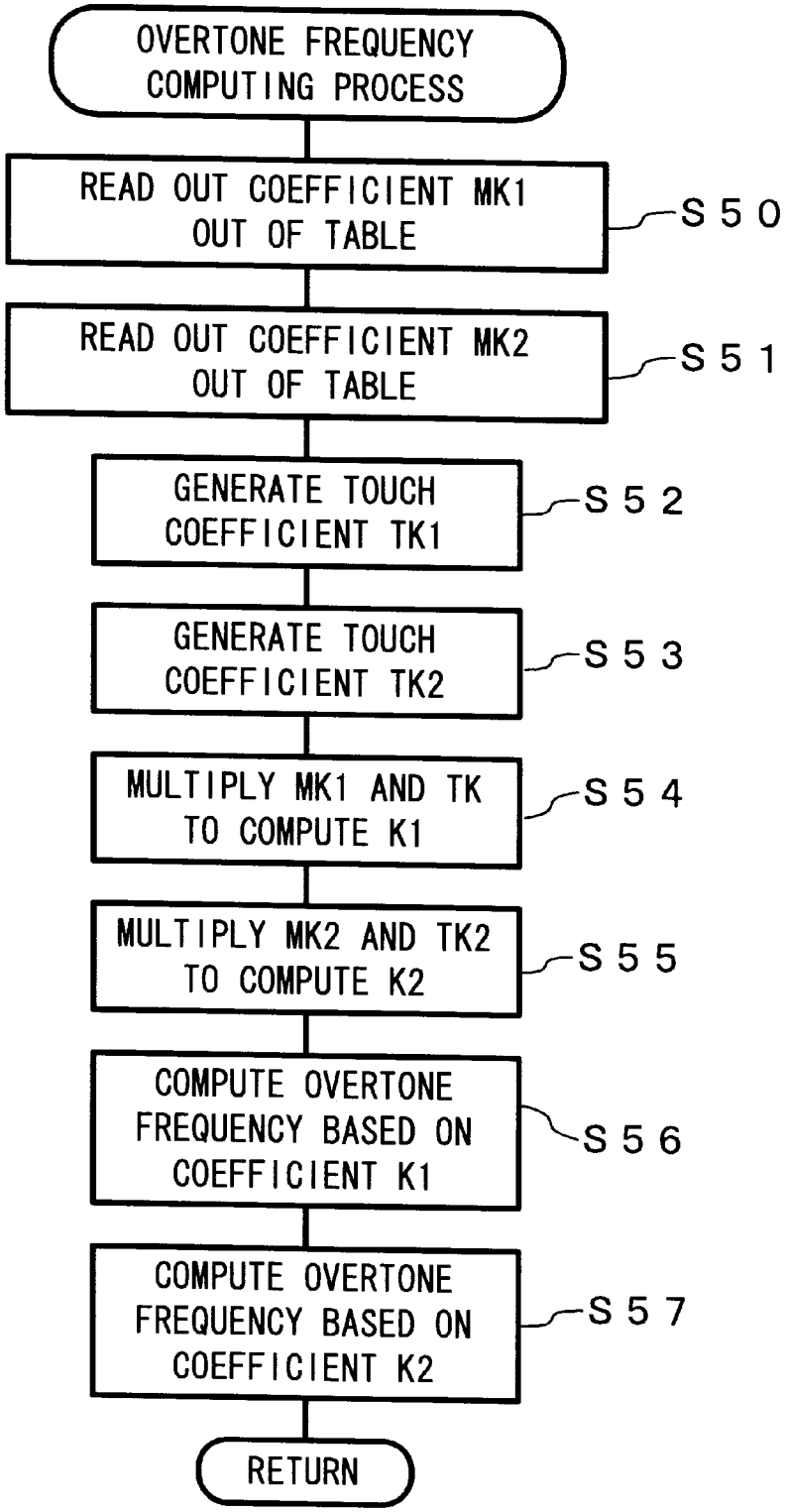
FIG. 6 is a flowchart showing an overtone frequency operational process.

FIG. 6 is a flowchart of the overtone frequency computing process. In FIG. 6, in step S50, the first fundamental inharmonicity coefficient MK1 is read from the first inharmonicity table selected as the upper series. In step S51, the second fundamental inharmonicity coefficient MK2 is read from the second inharmonicity table selected as the upper series. In step S52, the first inharmonicity touch coefficient Tk1 is generated based on the touch velocity detected by the touch sensor 2. Likewise, in step S53, the second inharmonicity touch coefficient Tk2 is generated based on the touch velocity. In processes of step S52 and step S53, the touch velocity is inputted to the touch curve table so as to generate inharmonicity touch coefficients Tk1 and Tk2.

In step S54, the first fundamental inharmonicity coefficient MK1 is multiplied by the first inharmonicity touch coefficient Tk1 to compute the first inharmonicity coefficient K1. In step S55, the second fundamental inharmonicity coefficient MK2 is multiplied by the second inharmonicity touch coefficient Tk2 to compute the first inharmonicity coefficient K2. In step S56, overtone frequencies of the upper series wave form are computed using the first inharmonicity coefficient K1. In step S57, overtone frequencies of the lower series wave form are computed using the second inharmonicity coefficient K2.

Figure 7:
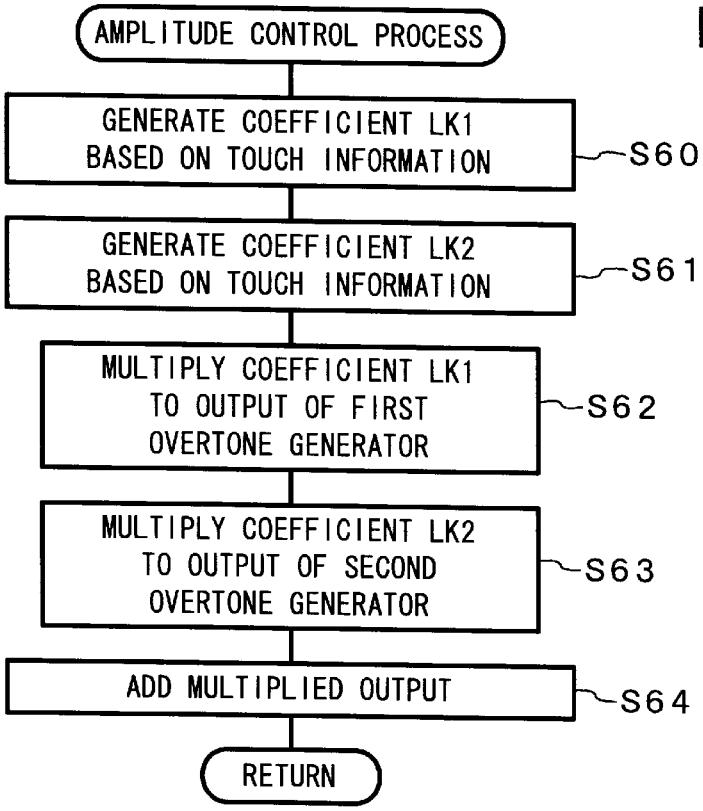
FIG. 7 is a flowchart showing an amplitude control process.

FIG. 7 is a flowchart of an amplitude control process. In step S60, the first amplitude coefficient LK1 is generated based on touch information, and in step S61, the second amplitude coefficient Lk2 is generated based on the touch information. In step S62, each output of the first overtone generator section 21 is multiplied by the first amplitude coefficient LK1. In step S63, each output of the second overtone generator section 22 is multiplied by the second amplitude coefficient Lk2. In step S64, the multiplied results computed in steps S62 and step S63 are added to each other to synthesize a musical tone signal.

The aforesaid embodiment has one type of inharmonicity touch coefficient table. However, many types of inharmonicity touch coefficient tables corresponding to many types of timbre may be prepared like the inharmonicity table group 13. In this case, there is provided an inharmonicity touch coefficient table selection information generator section for selecting one of the inharmonicity touch coefficient tables based on timbre information, as in the above embodiment.

Moreover, an inharmonicity touch coefficient table may be provided for each of pitch range. For example, three kinds of inharmonicity touch coefficient tables may be provided for low, intermediate and high pitch ranges in the ROM. A pitch range is discriminated based on key code. And a table corresponding to the discriminated range is selected, and inharmonicity touch coefficients Tk1 and Tk2 are read out of it. By doing so, it is possible to generate a musical sound similar to the natural sound for each pitch range. It is preferable that the first and second overtone generator sections 21 and 22 generate a musical sound according to the sine wave harmonics synthesis method as mentioned above. However, the method is not limited to the sine wave additive synthesis method. Any other methods may be employed to synthesize musical tone waves so long as a frequency can be controlled for each overtone.

A second embodiment of the present invention will be described below. In the second embodiment, inharmonicity touch coefficient generator means and amplitude coefficient generator means are not provided independently for each upper series and lower series, but are provided in common for both series. Whereby it is possible to reduce the number of tables for setting the inharmonicity touch coefficient and the amplitude coefficient; therefore, memory capacity required can be reduced.

Figure 10:
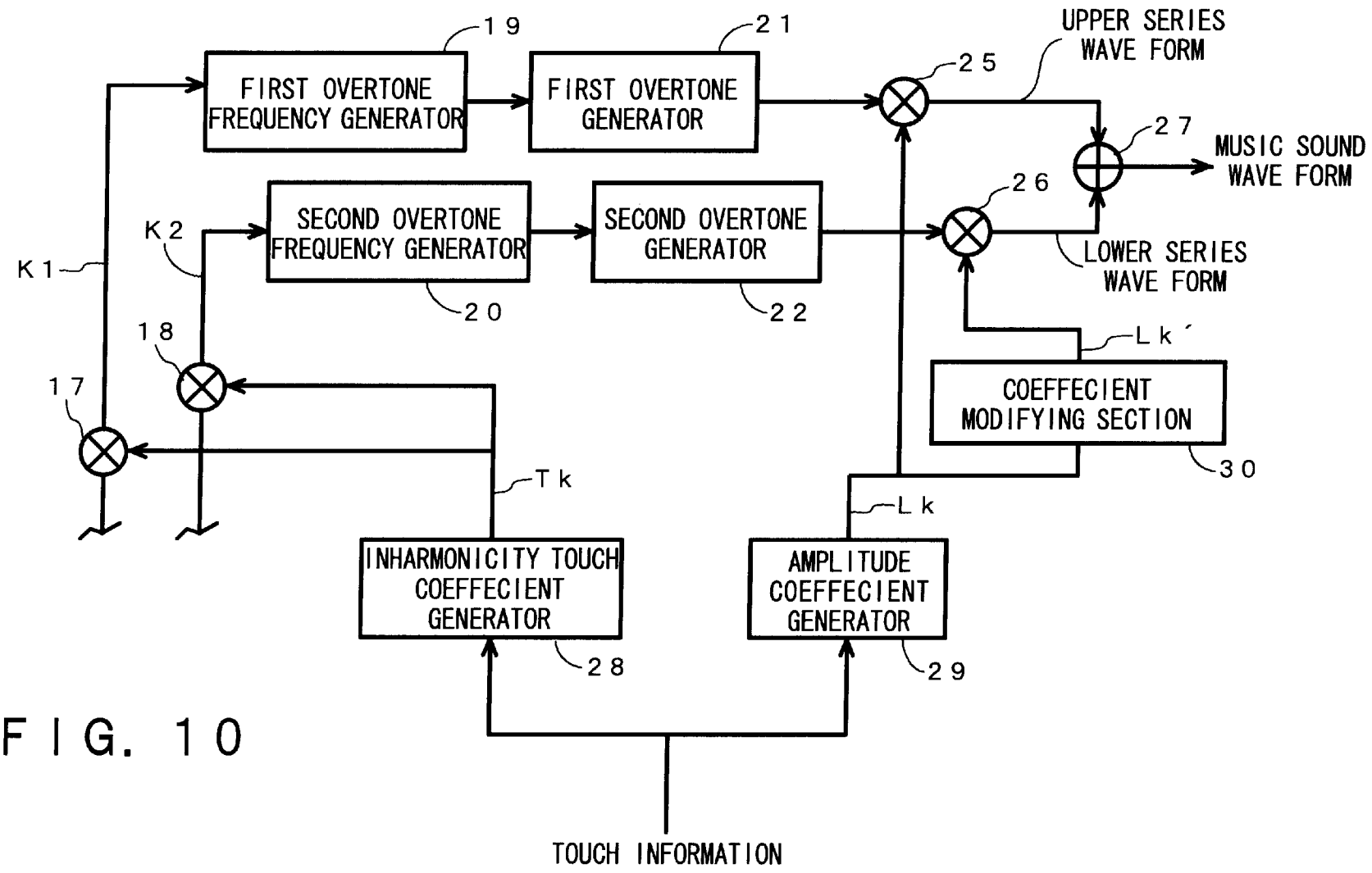
FIG. 10 is a block diagram showing principal functions of a musical sound synthesizing apparatus according to a second embodiment of the present invention.
Figure 11:
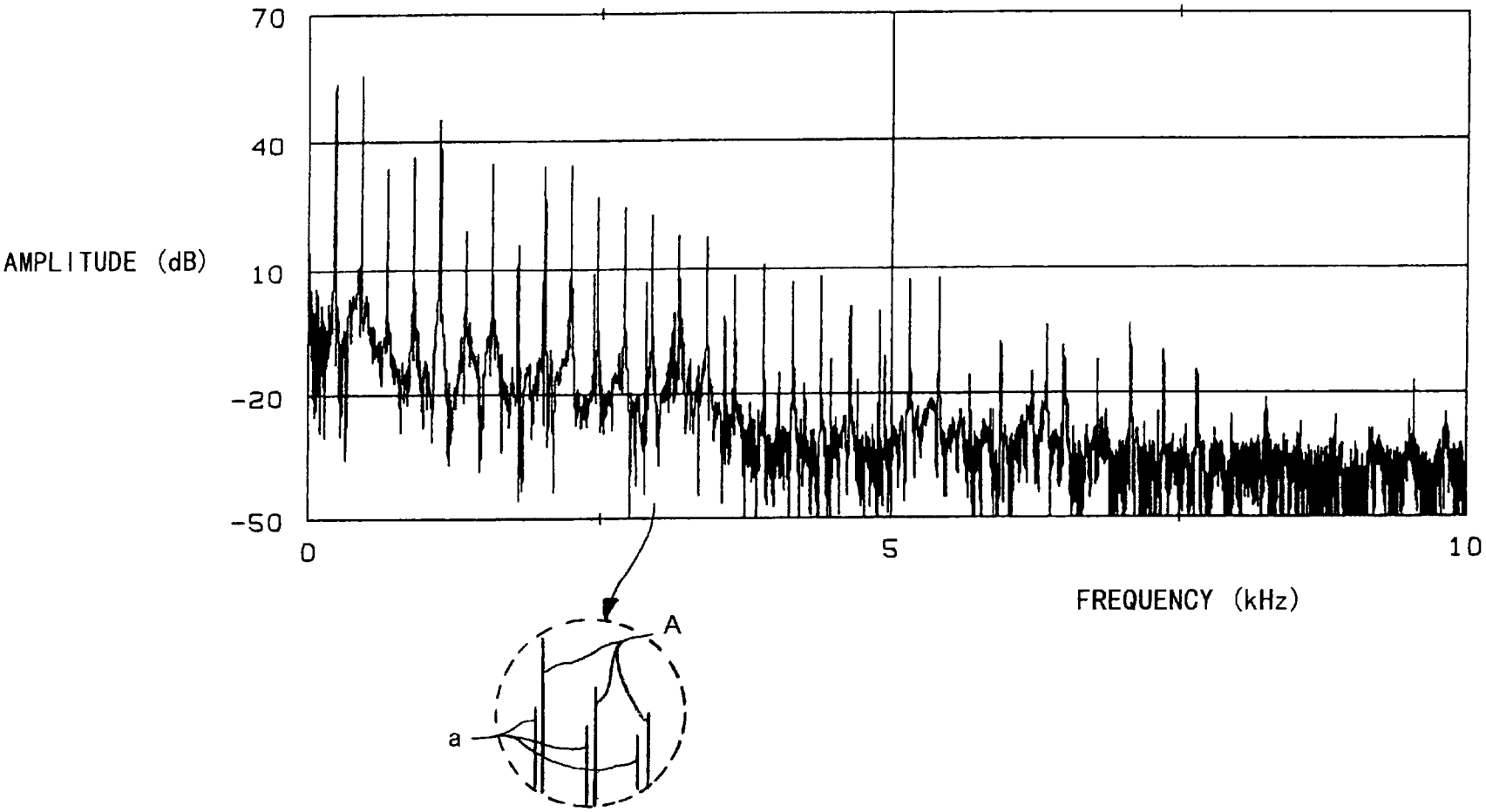
FIG. 11 is a diagram showing an example of a spectrum distribution of a piano sound.
Figure 12:
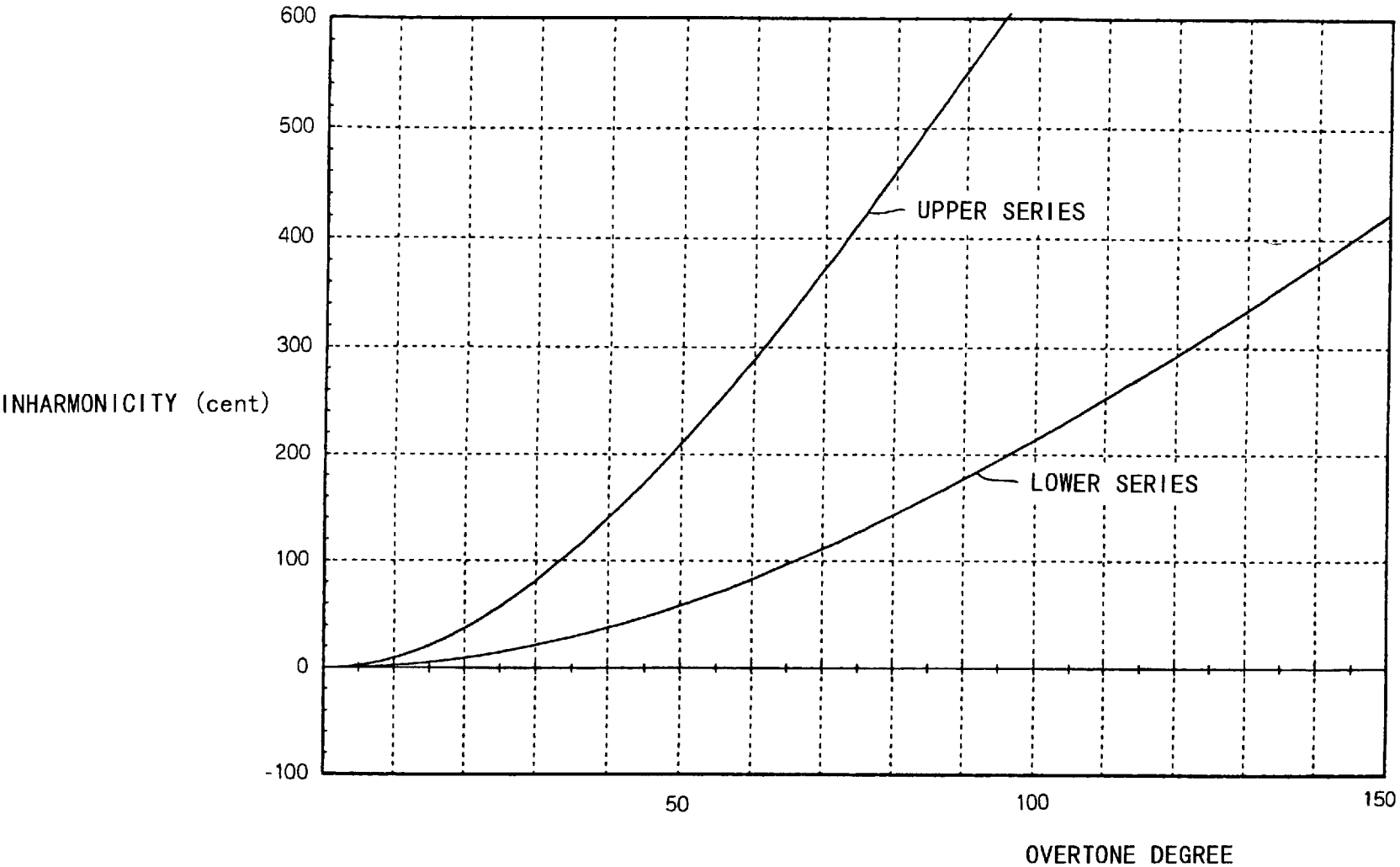
FIG. 12 is a diagram showing an example of inharmonicity of a piano sound corresponding to an overtone degrees.

FIG. 10 is a block diagram showing functions of principal parts of a musical sound synthesizing apparatus according to the second embodiment of the present invention. In FIG. 10, the same reference numerals as FIG. 1 denote the identical or equivalent parts. In FIG. 10, a inharmonicity touch coefficient generator section 28 includes a touch curve table which outputs a single common inharmonicity touch coefficient Tk when touch information is inputted. The touch curve table may be the same one as described in the first embodiment. The inharmonicity touch coefficient Tk is supplied to the multipliers 17 and 18. Therefore, inharmonicity of upper-series and lower-series wave forms varies in the same manner in accordance with the touch velocity.

An amplitude coefficient generator section 29 includes a table for outputting an amplitude coefficient Lk in accordance with touch information. The amplitude coefficient Lk is supplied to a multiplier section 25 where upper-series overtones outputted from the first overtone generator section 21 are multiplied by the amplitude coefficient Lk, and then accumulated with each other. Further, the amplitude coefficient Lk is inputted to a coefficient modifying section 30 which modifies the amplitude coefficient Lk as a coefficient for a lower series. For example, the coefficient modifying section 30 generates the modified amplitude coefficient Lk' according to an operational expression "1−Lk". The amplitude coefficient Lk' is supplied to the multiplier section 26 where lower-series overtones are multiplied by the amplitude coefficient Lk', and then accumulated with each other. In FIG. 10, therefore, a mixed musical sound wave form is generated at the adder 27 so that upper-series and lower-series wave forms are cross-faded, that is, the larger the amplitude of one wave form becomes, the smaller the amplitude of the other becomes. The operational expression used in the coefficient modifying section 30 is not limited to "1−Lk" as mentioned above. Other operational expressions such as "0.5×Lk", "$Lk^2$", or the like may be used therein.

As is apparent from the above description, according to the present invention, it is possible to generate plural-series of overtones having amplitude levels and inharmonicity which are different each other in accordance with a pitch of musical sound, a timbre and touch strength. As a result, for example, it is possible to more faithfully reproduce sounds of natural musical instruments including a so-called partial sound having a split frequency component of a series different from the essential overtone.

What is claimed is:

1. A musical sound synthesizing apparatus comprising:

a plurality of inharmonicity coefficient generator means supplied with a pitch information of a musical sound, for outputting different inharmonicity coefficients, respectively, previously set in accordance with the pitch information;

a plurality of overtone frequency generator means for computing a plurality of series of overtone frequencies, each series of the plurality of series of overtone frequencies using a different one of the inharmonicity coefficients and a fundamental frequency corresponding to the pitch information; and a plurality of overtone generator means for generating a musical sound signal corresponding to the plurality of series of overtone frequencies;

wherein the inharmonicity coefficients correspond respectively to a plural-series of overtones for a fundamental frequency, each series of overtones of the plural-series having amplitude levels and inharmonicities which are different from the others.

2. A musical sound synthesizing apparatus according to claim 1, wherein the musical sound synthesizing apparatus further includes:

inharmonicity touch coefficient generator means being supplied with a touch information, for outputting inharmonicity touch coefficients previously set in accordance with the touch information; and a plurality of first multiplier means for multiplying each of the plurality of inharmonicity coefficients outputted from the inharmonicity coefficient generator means by each of the inharmonicity touch coefficients, wherein the overtone frequency generator means computes the overtone frequencies by using the plurality of inharmonicity coefficients multiplied by the inharmonicity touch coefficients.

3. A musical sound synthesizing apparatus according to claim 2, wherein the inharmonicity touch coefficients generator means generates a plurality of inharmonicity touch coefficients which are different from each other in accordance with the plural-series of overtones.

4. A musical sound synthesizing apparatus according to claim 1, wherein the musical sound synthesizing apparatus further includes:

amplitude coefficient generator means being supplied with a touch information, for outputting a plurality of amplitude coefficients for the plural-series of overtones in accordance with the touch information;

a plurality of second multiplier means for individually multiplying the plural-series of overtones outputted from the overtone generator means by a corresponding amplitude coefficient; and adder means for adding plurality outputs of the multiplier means with each other to generate a musical sound.

5. A musical sound synthesizing apparatus according to claim 4, wherein the amplitude coefficient generator means comprising a table supplied with a touch information, and outputting a first amplitude coefficient in accordance with the touch information; and coefficient modifying means for modifying a first amplitude coefficient using a predetermined function to produce a second amplitude coefficient.

6. A musical sound synthesizing apparatus according to claim 1, wherein the inharmonicity coefficient generator means further includes inharmonicity coefficient tables corresponding to the plural-series of overtones set for each timbre, and the musical sound synthesizing apparatus further includes inharmonicity coefficient table selection means for selecting one of the inharmonicity coefficient tables based on timbre information.

7. A musical sound synthesizing apparatus according to claim 2, wherein the inharmonicity touch coefficient generator means comprising a plurality of inharmonicity touch coefficient tables set for each timbre; and inharmonicity touch coefficient table selection means for selecting one of the plurality of the inharmonicity touch coefficient tables based on the timbre information.

8. A musical sound synthesizing apparatus according to claim 2, wherein the inharmonicity touch coefficient generator means further includes a plurality of inharmonicity touch coefficient tables each of which is set for each sound range, and inharmonicity touch coefficient table selection means for selecting one of the plurality of the inharmonicity touch coefficient tables based on pitch range information.

9. A musical sound synthesizing apparatus according to claim 1, wherein the inharmonicity coefficient generator means further includes a plurality of inharmonicity coefficient tables, and the musical synthesizing apparatus further includes inharmonicity coefficient table selection means for selecting the plurality of predetermined inharmonicity coefficient tables corresponding to the plural-series of overtones based on timbre information.

10. A method of synthesizing a musical sound reproducing a split spectrum comprising the steps of:

determining different inharmonic coefficients from a pitch information, the pitch information corresponding to a keyboard number;

determining a fundamental frequency from the pitch information;

calculating a plurality of series of overtone frequencies, each series of the plurality of series of overtone frequencies using a different one of the inharmonicity coefficients and the fundamental frequency;

producing a plurality of waveforms, each waveform corresponding to one of the series of overtone frequencies;

forming a single waveform by mixing the plurality of waveforms; and generating a musical sound from the single waveform formed.

11. A musical sound synthesizing apparatus comprising:

an inharmonicity coefficient generator supplied with pitch information of a musical sound, outputting a first inharmonicity coefficient and a second inharmonicity coefficient predetermined in accordance with the pitch information;

a first overtone frequency generator computing a first series of overtone frequencies using the first inharmonicity coefficient and a fundamental frequency corresponding to the pitch information;

a second overtone frequency generator computing a second series of overtone frequencies using the second inharmonicity coefficient and the fundamental frequency corresponding to the pitch information;

an overtone generator for generating a musical sound signal by combining the first series of overtone frequencies with the second series of overtone frequencies;

wherein the first inharmonicity coefficient corresponds to an upper series of overtones for the fundamental frequency and the second inharmonicity coefficient corresponds to a lower series of overtones for the fundamental frequency, the upper series of overtones having different amplitude levels and inharmonicities from the lower series of overtones.

* * * * *